US008782886B2

(12) United States Patent
Liao

(10) Patent No.: US 8,782,886 B2
(45) Date of Patent: Jul. 22, 2014

(54) METHOD FOR MAKING A CEILING FAN BLADE

(76) Inventor: Hsien-Chin Liao, Taichung (TW)

( * ) Notice: Subject to any disclaimer, the term of this patent is extended or adjusted under 35 U.S.C. 154(b) by 97 days.

(21) Appl. No.: 13/552,351

(22) Filed: Jul. 18, 2012

(65) Prior Publication Data

US 2014/0020247 A1 Jan. 23, 2014

(51) Int. Cl.
*B23P 15/02* (2006.01)

(52) U.S. Cl.
USPC ..... 29/889.3; 29/889.71; 416/241 R

(58) Field of Classification Search
USPC ..... 29/889.3, 889.71; 416/210 R, 142, 416/241 R; 427/557; 428/106
See application file for complete search history.

(56) References Cited

U.S. PATENT DOCUMENTS

| | | | | |
|---|---|---|---|---|
| 5,820,943 | A * | 10/1998 | Huang | 427/510 |
| 2005/0002790 | A1* | 1/2005 | Lin | 416/210 R |
| 2008/0213532 | A1* | 9/2008 | Engel et al. | 428/106 |
| 2011/0129296 | A1* | 6/2011 | Van Velsor | 404/79 |
| 2013/0260052 | A1* | 10/2013 | Li et al. | 427/475 |

* cited by examiner

*Primary Examiner* — Alexander P Taousakis
(74) *Attorney, Agent, or Firm* — Banger Shia

(57) ABSTRACT

A method for making a ceiling fan blade comprises the steps of cutting, inside drying, surface wetting, surface spraying, and surface forming. The method is capable of reducing production cost and loss rate, reducing the harm to human health, preventing environmental pollution, and preventing the ceiling fan blades from perishing and deformation by dehydrating the ceiling fan blades.

3 Claims, 8 Drawing Sheets

METHOD FOR MAKING A CEILING FAN BLADE

BACKGROUND OF THE INVENTION

1. Field of the Invention

The present invention relates to a ceiling fan blade, and more particularly to a method for making a ceiling fan blade.

2. Description of the Prior Art

Usually, the method for making a ceiling fan blade involves: spraying varnish on the upper and lower surfaces of a large wood board; cutting the large wood board into a raw fan blades of a predetermined shape; stacking the raw fan blades one upon another in such a manner that only the periphery edges of the fan blades are exposed; spraying premier repeatedly on the periphery edges of the fan blades; taking off the raw fan blades one by one, after the premier dries, and grinding and polishing the periphery edges; stacking the raw fan blades which have been ground and polished in the same manner that only the periphery edges of the fan blades are exposed; spraying varnish on the periphery edges of the fan blades; taking off the raw fan blades one by one, and thus the final products of the fan blades are obtained. However, this method for making a ceiling fan still suffers the following disadvantages:

Firstly, high production cost: since the making of the ceiling fan blade involves too many steps, and the polishing and grinding of the periphery edge can only be performed a single raw fan blade.

Secondly, high loss rate: the periphery edge of the respective raw fan blades should be sprayed with premier repeatedly, the neighboring fan blades are likely to stuck to each other after the premier dries, the later taking-off of the raw fan blades may cause damage to the premier on the periphery edges of the raw fan blades.

Thirdly, adverse influence on human health and environment: the making of the ceiling fan blade involves the spraying of premier and varnish, and the premier and varnish contains formaldehyde, pine fragrance, hydrogen peroxide and other toxic substances, which not only does harm to workers' health, but also pollutes environment.

Fourthly, the conventional method of the ceiling fan blade doesn't involve drying step, if the moisture rate of the fan blade is high, the fan blade is perishable and likely to deform. Furthermore, the premier and the varnish are not water proof, the fan blade will become wet and accordingly will be perishable and likely to deform if it is used in a humid environment for a long time.

The present invention has arisen to mitigate and/or obviate the afore-described disadvantages.

SUMMARY OF THE INVENTION

The primary object of the present invention is to provide a method for making a ceiling fan blade, which is capable of reducing production cost.

Another object of the present invention is to provide a method for making a ceiling fan blade, which is capable of reducing loss rate.

Another object of the present invention is to provide a method for making a ceiling fan blade, which is capable of reducing the harm to human health and preventing environmental pollution.

Yet another object of the present invention is to provide a method for making a ceiling fan blade, which is capable of preventing the ceiling fan blades from perishing and deformation by dehydrating the ceiling fan blades.

To achieve the above objects, a method for making a ceiling fan blade in accordance with the present invention comprises: cutting a wood board into a plurality of raw fan blades; hanging the raw fan blades and heating the raw fan blades with infrared rays generated from an infrared generator at a temperature ranging 100-200° C. for 1-3 minutes, so as to drive moisture inside the raw fan blades to a surface of each of the raw fan blades; putting the raw fan blades into a steam room for 10-20 seconds, so as to wet the surface of the raw fan blades; spraying thermosetting powder on the surface of the raw fan blades with a sprayer, so that the thermosetting powder melts and sticks to the surface of the raw fan blades when wet (by the moisture on the surface of the raw fan blades), so as to form an unsolidified layer on the surface of the fan blades; and heating the raw fan blades with the infrared rays generated from an infrared generator at a temperature ranging 100-150° C. for 1-2 minutes, so as to solidify unsolidified layer into a solidified layer.

Preferably, the wood board is selected from a group consisting of dense board, solid wood, bamboo board, and plywood.

Preferably, the thermosetting powder is selected from the group consisting of hydroxyl group polyester resin, carboxylic group polyester resin, acid anhydride, phenol resin, aromatic amine, aliphatic amine.

DETAILED DESCRIPTION OF THE PREFERRED EMBODIMENTS

The present invention will be clearer from the following description when viewed together with the accompanying drawings, which show, for purpose of illustrations only, the preferred embodiment in accordance with the present invention.

Figure 1:
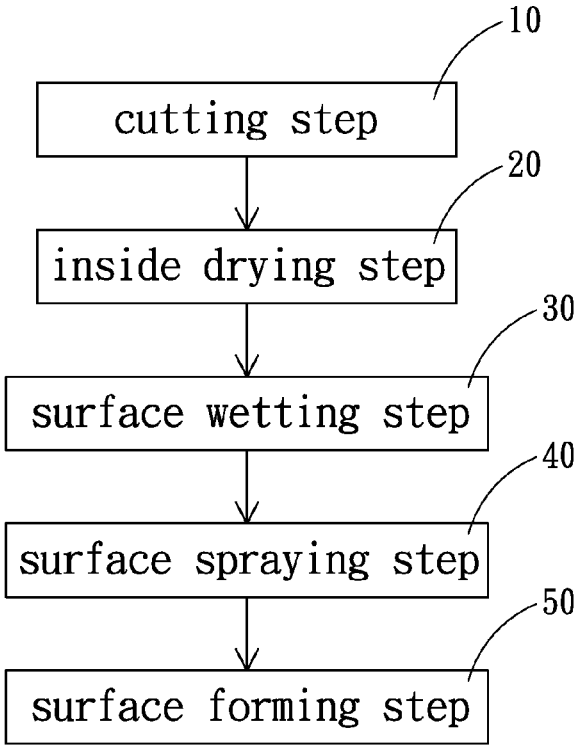
FIG. 1 is a flow chart showing the steps of a method for making a ceiling fan blade in accordance with the present invention.

Referring to FIG. 1, a method for making a ceiling fan blade in accordance with the present invention comprises: a cutting step 10, an inside drying step 20, a surface wetting step 30, a surface spraying step 40, and a surface forming step 50.

Figure 2:
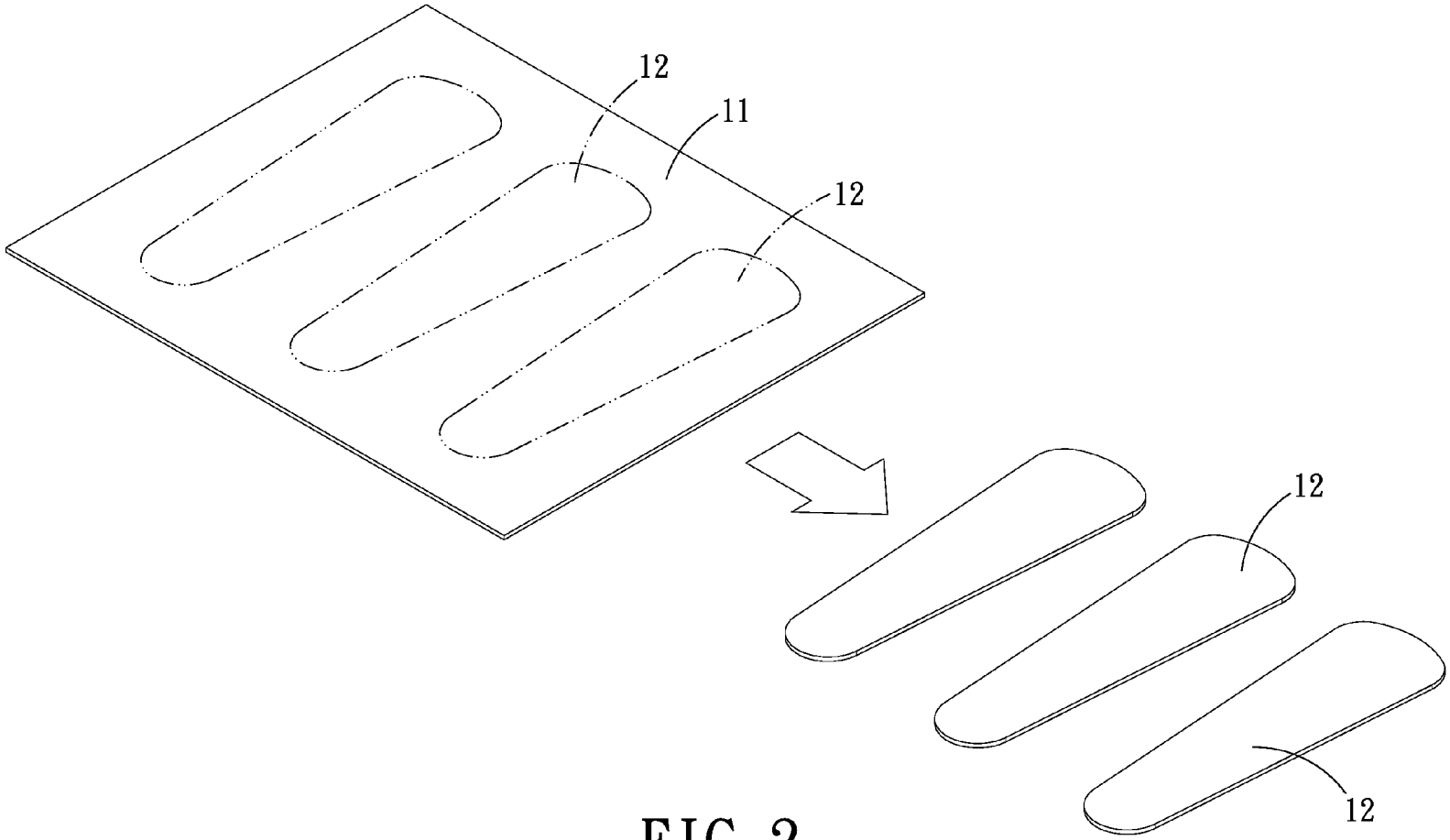
FIG. 2 is an illustrative view showing the cutting step of the method for making a ceiling fan blade in accordance with the present invention.

The cutting step 10, as shown in FIG. 2, is to cut a large wood board 11 into a plurality of raw fan blades 12. In this embodiment, the wood board 11 is cut into three pieces of raw fan blades 12, for example, and the wood board 11 can be dense board, solid wood, bamboo board, or plywood.

Figure 3:
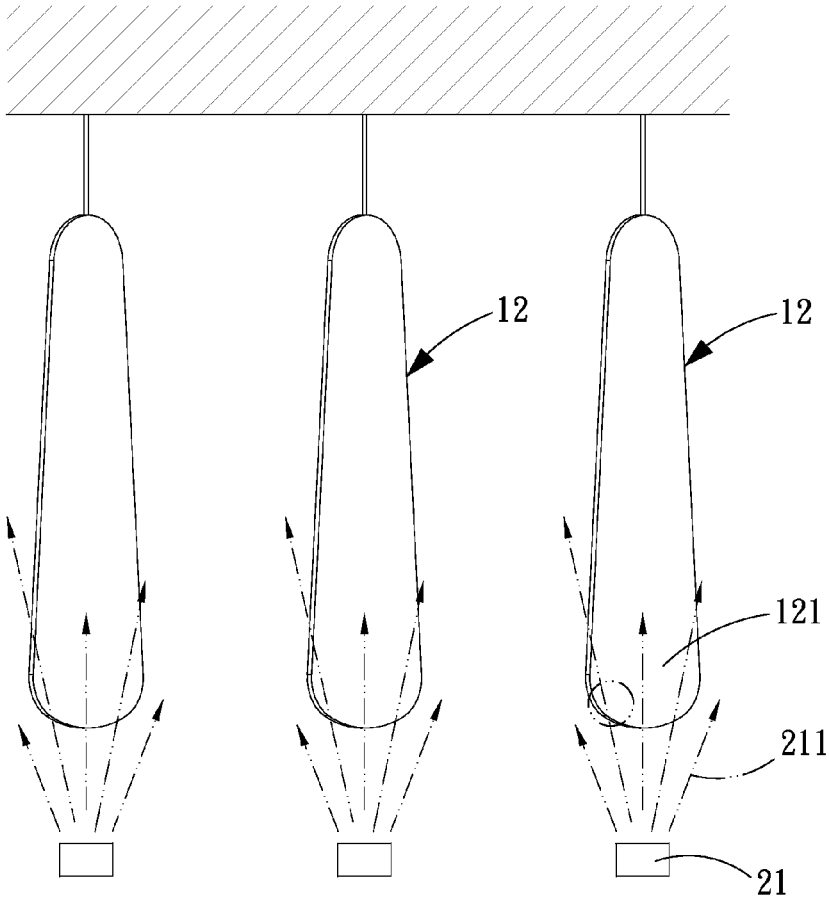
FIG. 3 is an illustrative view showing the inside drying step of the method for making a ceiling fan blade in accordance with the present invention.
Figure 4:
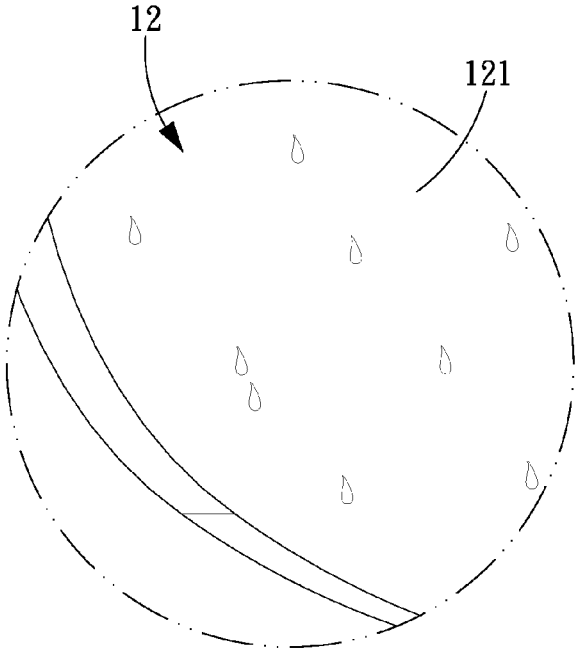
FIG. 4 is an enlarged view of a part of FIG. 3.

The inside drying step 20, as shown in FIGS. 3 and 4, is to hang the raw fan blades 12 and then heat the raw fan blades 12 with infrared rays 211 generated from an infrared generator 21 at a temperature ranging 100-200° C. for 1-3 minutes, so as to drive the moisture inside the raw fan blades 12 to the surface 121 of the raw fan blades 12.

Figure 5:
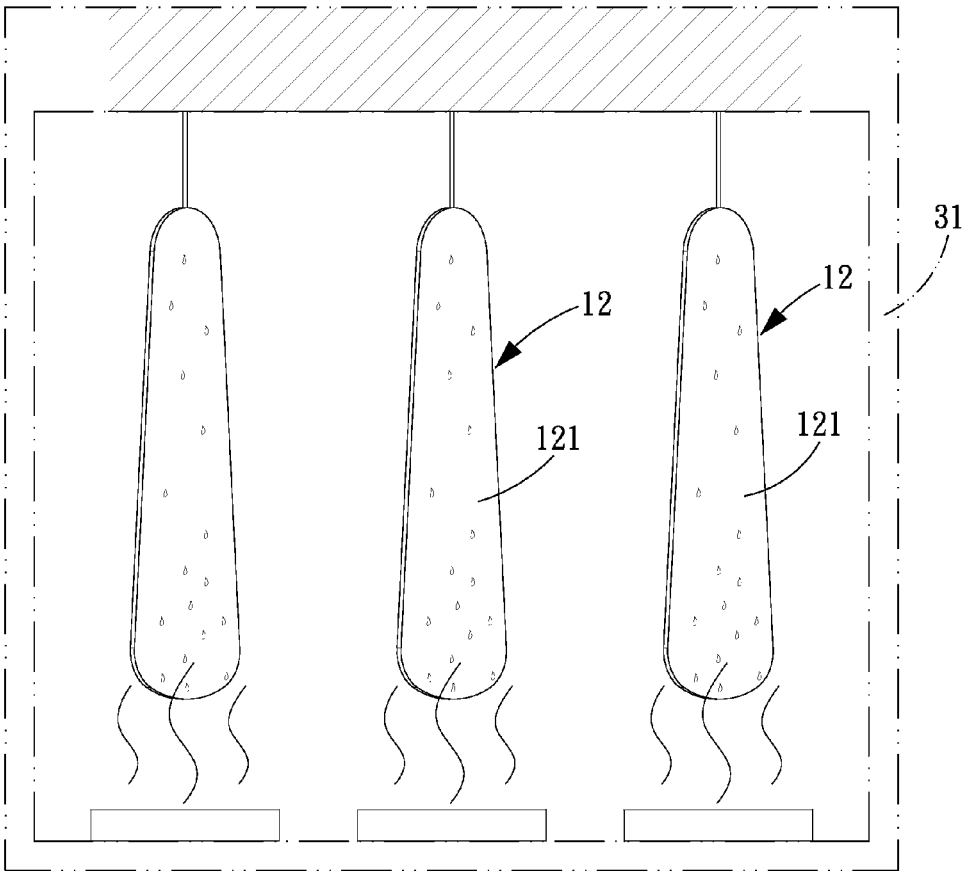
FIG. 5 is an illustrative view showing the surface wetting step of the method for making a ceiling fan blade in accordance with the present invention.

The surface wetting step 30, as shown in FIG. 5, is to put the raw fan blades 12 into a steam room 31 for 10-20 seconds, so as to wet the surface 121 of the raw fan blades 12.

Figure 6:
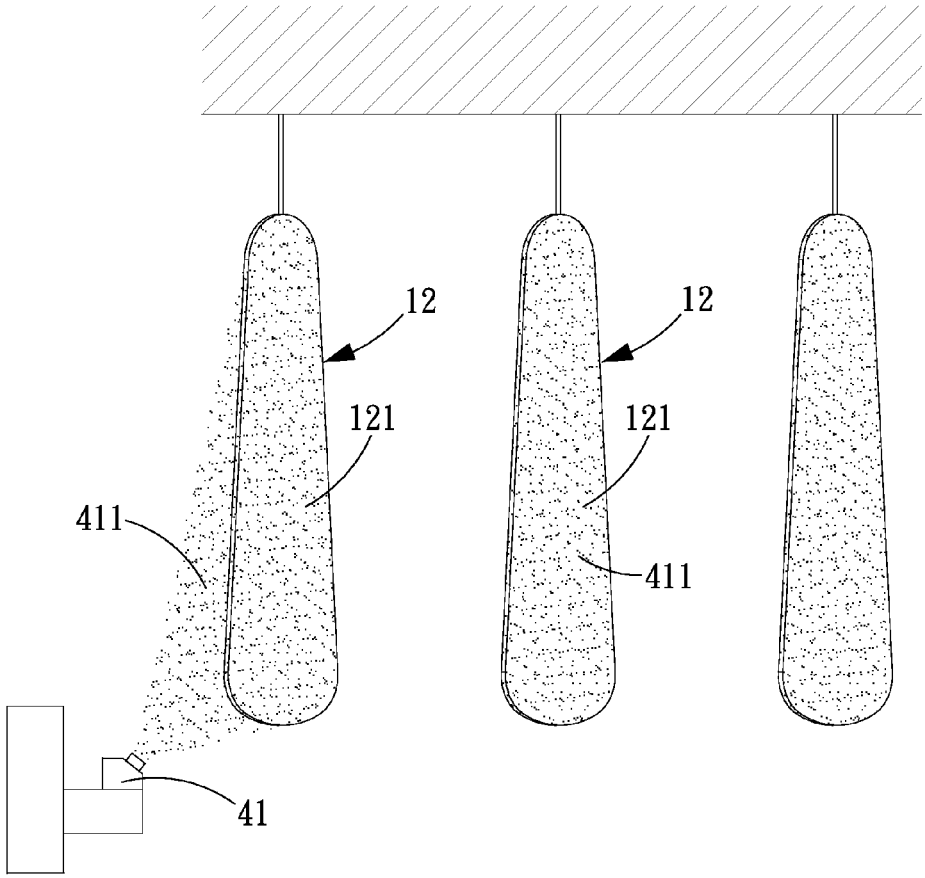
FIG. 6 is an illustrative view showing the surface spraying step of the method for making a ceiling fan blade in accordance with the present invention.

The surface spraying step 40, as shown in FIG. 6, is to spray thermosetting powder 411 on the surface of the raw fan blades 12 with a sprayer 41, so that the thermosetting powder 411 will melt and stick to the surface 121 of the raw fan blades 12 when wet (by the moisture on the surface 121 of the raw fan blades 12), so as to form an unsolidified layer on the surface 121. The thermosetting powder 411 is selected from the group consisting of hydroxyl group polyester resin, carboxylic group polyester resin, acid anhydride, phenol resin, aromatic amine, aliphatic amine.

Figure 7:
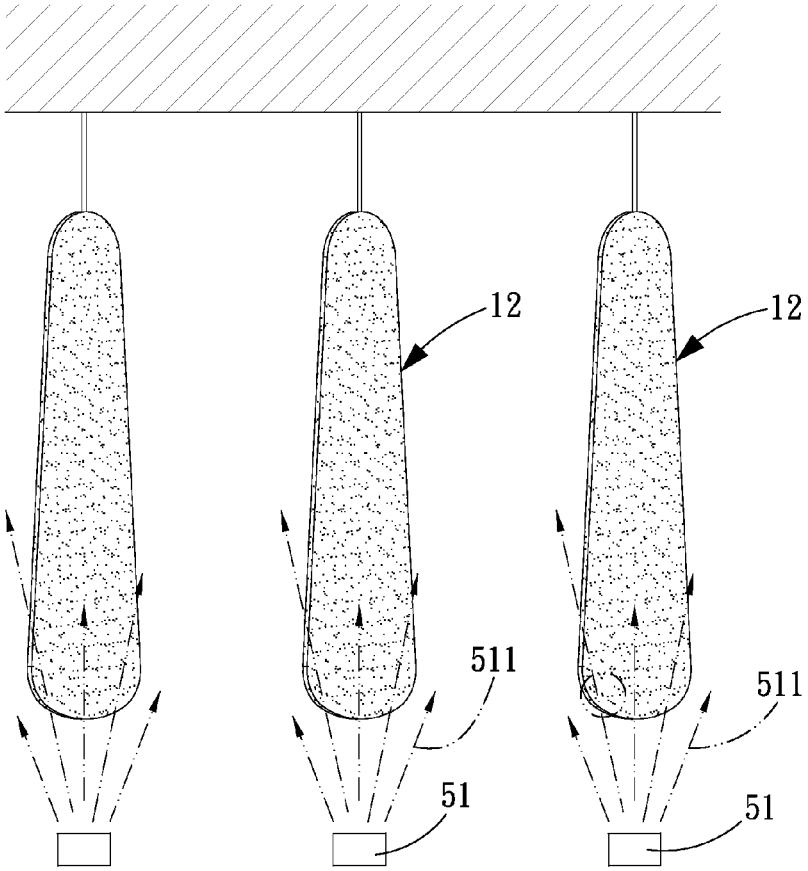
FIG. 7 is an illustrative view showing the surface forming step of the method for making a ceiling fan blade in accordance with the present invention.
Figure 8:
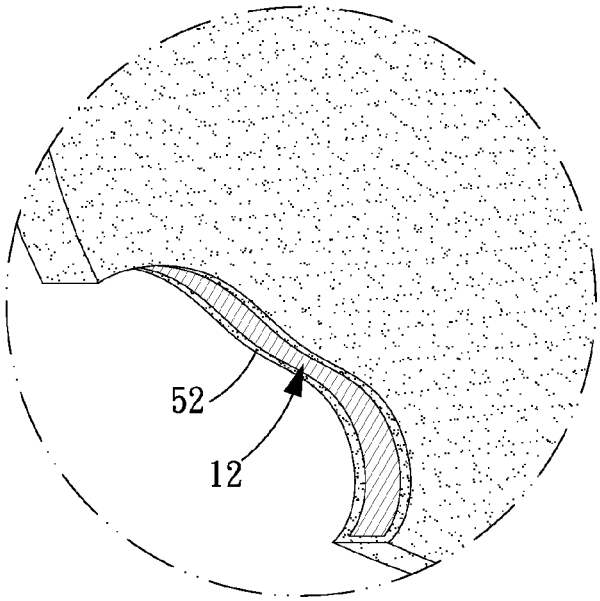
FIG. 8 is an enlarged view of a part of FIG. 7.

The surface forming step 50, as shown in FIGS. 7 and 8, is to heat the raw fan blades 12 with the infrared rays 511 generated from an infrared generator 51 at a temperature ranging 100-150° C. for 1-2 minutes, so that the unsolidified layer is solidified into a solidified layer 52 on the surface 121.

What mentioned above are the steps of the method for making a ceiling fan blade in accordance with the present invention, and the merits of the present are explained as follows.

Firstly, decreasing production cost: the method for making a ceiling fan blade in accordance with the present invention is simplified since it only includes five continuous steps: the cutting step, the inside drying step, the surface wetting step, the surface spraying step, and the surface forming step.

Secondly, low loss rate: the method for making a ceiling fan blade in accordance with the present invention doesn't involve the steps of stacking the raw fan blades and spraying the premier and varnish, so that the conventional problem that the neighboring fan blades are stuck to each other after the premier dries, and the later taking-off of the raw fan blades may cause damage to the premier on the periphery edges of the raw fan blades, can be avoided. Hence, the loss rate of the present invention is decreased.

Thirdly, reducing the harm to human health and preventing environmental pollution: the material to be sprayed on the raw fan blades is thermosetting powder which is a non-toxic, tasteless, no stimulation, pollution-free paint, which reduces the harm to human health and prevents environmental pollution.

Fourthly, the method for making a ceiling fan blade in accordance with the present invention includes the drying step which drives the moisture inside the raw fan blades to the outer surface, so that the moisture of the fan blades is low, and accordingly the fan blades are less likely to perish and deform. Moreover, the solidified layer formed on the surface of the fan blades is water proof, which further prevents the fan blades from perishing and deformation. Especially, the thermosetting powder will melt and stick to the surface of the raw fan blades when get wet by the moisture, forming an unsolidified layer to seal all capillaries of the fan blades, hence, the ceiling fan blades made by the method of the present invention can be effectively prevented from perish and deformation even if used in a humidity environment for a long time.

While we have shown and described various embodiments in accordance with the present invention, it is clear to those skilled in the art that further embodiments may be made without departing from the scope of the present invention.

What is claimed is:

1. A method for making a ceiling fan blade comprising:

cutting a wood board into a plurality of raw fan blades;

hanging the raw fan blades and heating the raw fan blades with infrared rays generated from an infrared generator at a temperature ranging 100-200° C. for 1-3 minutes, so as to drive moisture inside the raw fan blades to a surface of each of the raw fan blades;

putting the raw fan blades into a steam room for 10-20 seconds, so as to wet the surface of the raw fan blades;

spraying thermosetting powder on the surface of the raw fan blades with a sprayer, so that the thermosetting powder melts and sticks to the surface of the raw fan blades when wet by the moisture on the surface of the raw fan blades, so as to form an unsolidified layer on the surface of the fan blades; and heating the raw fan blades with the infrared rays generated from an infrared generator at a temperature ranging 100-150° C. for 1-2 minutes, so as to solidify the unsolidified layer into a solidified layer.

2. The method for making a ceiling fan blade as claimed in claim 1, wherein the wood board is selected from a group consisting of dense board, solid wood, bamboo board, and plywood.

3. The method for making a ceiling fan blade as claimed in claim 1, wherein the thermosetting powder is selected from the group consisting of hydroxyl group polyester resin, carboxylic group polyester resin, acid anhydride, phenol resin, aromatic amine, aliphatic amine.

* * * * *